US010669676B2

(12) United States Patent
Laugwitz

(10) Patent No.: US 10,669,676 B2
(45) Date of Patent: Jun. 2, 2020

(54) RUBBER-TIRE ROLLER FOR COMPACTING A GROUND AND METHOD FOR CONTROLLING A SPRINKLER SYSTEM OF A RUBBER-TIRE ROLLER

(71) Applicant: BOMAG GMBH, Boppard (DE)

(72) Inventor: Niels Laugwitz, Lahnstein (DE)

(73) Assignee: BOMAG GMBH, Boppard (DE)

( * ) Notice: Subject to any disclaimer, the term of this patent is extended or adjusted under 35 U.S.C. 154(b) by 0 days.

(21) Appl. No.: 16/205,788

(22) Filed: Nov. 30, 2018

(65) Prior Publication Data

US 2019/0211516 A1 Jul. 11, 2019

(30) Foreign Application Priority Data

Dec. 1, 2017 (DE) ..... 10 2017 011 146

(51) Int. Cl.

| | |
|---|---|
| ***E01C 19/23*** | (2006.01) |
| ***E01C 19/26*** | (2006.01) |
| ***E01C 19/27*** | (2006.01) |
| ***E01C 23/00*** | (2006.01) |

(52) U.S. Cl.

CPC ..... *E01C 19/238* (2013.01); *E01C 19/26* (2013.01); *E01C 19/27* (2013.01); *E01C 23/00* (2013.01)

(58) Field of Classification Search

CPC ..... E01C 19/238; E01C 19/26; E01C 19/27
See application file for complete search history.

(56) References Cited

U.S. PATENT DOCUMENTS

| | | | | |
|---|---|---|---|---|
| 2,430,781 A * | 11/1947 | Phalor | E01C 19/238 | 404/129 |
| 4,157,877 A * | 6/1979 | Lee | E01C 19/231 | 172/395 |
| 5,222,828 A * | 6/1993 | Magalski | E01C 19/238 | 180/20 |
| 8,500,363 B1 * | 8/2013 | Ries | E01C 19/264 | 404/104 |

(Continued)

FOREIGN PATENT DOCUMENTS

| | | |
|---|---|---|
| DE | 102016007166 | 12/2017 |
| EP | 3181753 | 6/2017 |

OTHER PUBLICATIONS

Search Report from corresponding German Appln. No. 10 2017 011 146.4, dated Aug. 10, 2018.

*Primary Examiner* — Abigail A Risic
(74) *Attorney, Agent, or Firm* — Grossman, Tucker, Perreault & Pfleger, PLLC

(57) ABSTRACT

A rubber-tired roller for the compaction of a ground, in particular for asphalt compaction, with a machine frame, a drive engine, a chassis driven by said drive engine with a front chassis part and a rear chassis part, at least one chassis part comprising at least two tires with running surfaces, which are arranged next to one another, at least one sprinkler system for the tires of the chassis part, which is configured to apply a liquid separating agent to the running surfaces of the tires, and a control unit for controlling the sprinkler system, wherein a temperature sensor is provided which is configured and arranged such that it determines the temperature of at least one tire, in particular the running surface of said tire. The invention moreover relates to a method for controlling a sprinkler system of such a rubber-tired roller.

21 Claims, 4 Drawing Sheets

(56) References Cited

U.S. PATENT DOCUMENTS

| | | | | |
|---|---|---|---|---|
| 9,422,675 | B2 * | 8/2016 | Bornemann | E01C 19/264 |
| 9,512,575 | B2 * | 12/2016 | Bornemann | E01C 19/23 |
| 10,006,175 | B2 * | 6/2018 | Bornemann | E01C 19/23 |
| 10,196,791 | B1 * | 2/2019 | Oetken | E02D 3/0265 |
| 2004/0018053 | A1 * | 1/2004 | Starry, Jr. | E01C 19/238 404/129 |
| 2008/0292401 | A1 * | 11/2008 | Potts | E01C 19/238 404/95 |
| 2013/0223933 | A1 * | 8/2013 | Ries | E01C 19/238 404/129 |
| 2015/0167258 | A1 * | 6/2015 | Ries | E01C 19/238 404/84.05 |
| 2016/0053444 | A1 * | 2/2016 | Bornemann | E01C 19/23 404/128 |
| 2017/0175344 | A1 * | 6/2017 | Bornemann | E01C 19/23 |
| 2017/0356139 | A1 * | 12/2017 | Berg | E01C 5/085 |
| 2017/0356141 | A1 * | 12/2017 | Berg | E01C 19/002 |
| 2018/0072122 | A1 * | 3/2018 | Ries | B60G 9/02 |

* cited by examiner

RUBBER-TIRE ROLLER FOR COMPACTING A GROUND AND METHOD FOR CONTROLLING A SPRINKLER SYSTEM OF A RUBBER-TIRE ROLLER

FIELD

The invention relates to a rubber-tired roller for compacting a ground, in particular for asphalt compaction. Moreover, the invention relates to a method for controlling a sprinkler system of a rubber-tired roller.

BACKGROUND

Generic rubber-tired rollers are typically employed for ground compaction and in particular for asphalt compaction in road construction. They are self-propelled machines which usually include a machine frame, a drive engine and a chassis driven by the drive engine with a front chassis part and a rear chassis part. Typically, at least one chassis part comprises at least two tires with running surfaces, which are arranged next to one another. The tires are normally made of an elastic material, for example a rubber material. The elastic properties of the tires traveling over the ground result in a kneading or flexing effect, due to which the use of generic rubber-tired rollers results in a particularly effective pore seal at the surface of the layer to be compacted.

Particularly in road construction, it is a standard practice that the rubber-tired rollers travel over the asphalt material to be compacted while the latter is still hot. Due to the increased temperature, the viscosity of the binder portions of the asphalt layer, for example the bitumen, is still low enough, so that a sufficient compaction can be achieved. As the temperature of the asphalt decreases, however, it becomes more viscous and thus harder to compact. It is a known problem in asphalt compaction with rubber-tired rollers that the hot asphalt material adheres to cold tires of the rubber-tired roller due to the property described above. It thus frequently happens, in particular at the beginning of the works when the tires are still significantly colder than the asphalt material, that asphalt material sticks to the rubber tires, which can cause unevenness of the finished asphalt layer. The tires then heat up in the course of the works until the temperature difference between the tires and the asphalt material is so small that the material does no longer stick to the tires.

To counteract the adherence of material to the tires, it is known, on the one hand, to provide strippers at the rubber tires which remove adhering asphalt material mechanically. Moreover, it is known to employ a sprinkler system for the tires which is configured to apply a liquid separating agent, for example a solvent-free water-dilutable separating agent, to the running surfaces of the tires. A control unit for controlling said sprinkler system is typically also provided. By wetting the tires with said separating agent, adherence of the asphalt material can be prevented from the outset. This, however, requires the rubber-tired roller to carry large quantities of the separating agent. Moreover, the separating agent needs to be refilled once the supply carried by the rubber-tired roller has been exhausted. The aim is therefore to apply the separating agent to the running surfaces of the tires as economically as possible and only if it is actually necessary.

In order to minimize the consumption of separating agent in practice, the operator of the rubber-tired roller thus needs to estimate or monitor at which time there is no longer a risk of adherence of the asphalt material to the tires. Once the tires have been heated sufficiently, the sprinkler system can be turned off. If this is done too early, there is a risk that the asphalt layer is damaged by the removal of pieces adhering to the tires. On the other hand, if the operator turns the sprinkler system off too late, this results in an unnecessary consumption of separating agent. To give the operator an indication for controlling the sprinkler system, it is known in the prior art to determine the temperature of the ground. This enables the operator to better estimate how long he has to process the ground until the tires have heated up sufficiently. Even with the measurement of the ground temperature, however, the decision of the operator to turn the sprinkler system off remains very subjective, so that there is still the risk of damage to the asphalt layer on the one hand and unnecessary consumption of separating agent on the other hand.

SUMMARY

The object of the present invention is therefore to reduce the consumption of separating agent and at the same time to reduce the risk of damage to the ground layer to be compacted. More particularly, the object of the invention is to provide a solution as to how to achieve a more objective decision to turn a sprinkler system on or off in working operation. At the same time, this solution should also be as cost-effective as possible.

Specifically, with a rubber-tired roller as mentioned above, the object is achieved by providing a temperature sensor which is configured and arranged such that it determines the temperature of at least one tire, in particular the running surface of said tire. A basic idea of the present invention thus consists in directly determining the temperature of the tire and in particular the contact surface of the tire with the ground, i.e. the running surface. Thus, the temperature is now ascertained directly at the location where there is a risk of adherence of the asphalt material. Contactless temperature sensors, for example optical ones, are particularly suitable for use with the invention. They may be arranged in proximity to the tires, for example in the wheel box of the rubber-tired roller, where they may be oriented towards the running surface of the tire. An arrangement in immediate proximity to the tire is not necessary; instead, the temperature sensor merely needs to be arranged such that the tire to be measured is within its measuring area. In other words, at least one measuring point of the temperature sensor needs to be located on the tire, in particular on the running surface of the tire. The temperature of the running surface of the tire is a quantity that is associated with the adherence of asphalt material more directly than merely the temperature of the ground since the latter does not provide any information about the heating state of the rubber tire itself. The measured temperature of the tire, in particular of the running surface of the tire, can be indicated to the operator of the rubber-tired roller, so that he can make a considerably more precise estimate as to whether or not there is currently still a risk of adherence of asphalt material. The operator can therefore adapt the activation and/or deactivation of the sprinkler system to the actual need of sprinkling considerably more precisely, which all in all saves separating agent. It is also conceivable and comprised in the scope of the invention that the sprinkler system is additionally or alternatively controlled in a fully automatic manner by a control device which resorts to the temperature value of at least the temperature sensor to control the sprinkler system, in particular to turn the sprinkling on and/or off.

Generally, any suitable temperature sensor, in particular of the type measuring in a contactless manner, can be employed for the invention. Preferably, however, the temperature sensor is an optical temperature sensor with a measuring area and at least one measuring point. The temperature sensor may thus, for example, be configured as a thermal imaging or infrared camera. In a particularly preferred embodiment, the temperature sensor comprises an infrared sensor array, i.e. the temperature sensor is configured as an infrared sensor array. An infrared sensor array is a measuring device that can be used to determine the temperature of multiple measuring points simultaneously. An infrared sensor array may, for example, be considered as an infrared camera with only a few image points or pixels, which constitute the measuring points. An infrared sensor array may, for example, include 16×4 pixels or measuring points. However, other resolutions are also possible and can be employed according to the invention. Additionally or alternatively, use may also be made of a temperature scanner. The latter includes essentially only a single measuring point but points it at least two different locations on a rubber tire and/or at least one location on at least two rubber tires in an alternating manner.

Rubber-tired rollers usually include several tires arranged next to one another. The tires may have different temperatures depending on the operating situation of the rubber-tired roller. The rubber-tired roller may, for example, travel partially on an asphalt strip that has already cooled down and partially on an asphalt strip that is still hot, so that the tires respectively contacting the hot or cold asphalt have different temperatures. In order to also obtain information about such varying temperature conditions, the optical temperature sensor is preferably configured and arranged such that the measuring area comprises at least one respective measuring point on at least two tires, in particular on the running surface of the respective tire. The at least two tires may, for example, be arranged directly next to one another. Moreover, they may, for example, be two adjacent tires that are arranged on the far left or the far right side of the chassis part transversely to the working direction of the rubber-tired roller. In particular the tires arranged at the outermost position transversely to the working direction oftentimes have a different temperature than the tires arranged at inner positions next to the outer tires. This is because the tires arranged at inner positions are already shielded against the environment by the outer tires. A temperature difference is therefore to be expected in particular between these tires.

The optical temperature sensor is particularly preferably configured and arranged such that the measuring area comprises at least one measuring point on each tire of the respective chassis part, in particular on the running surface of the respective tire. In this manner, the temperature sensor determines the temperature of every single tire of the chassis part. This information can then, for example, be indicated to the operator or can be employed directly for controlling the sprinkler system, as will be described in more detail below. If the temperature data is known for every single tire, a particularly efficient decision can be made as to whether the sprinkler system needs to be activated or deactivated, depending on which tire with which temperature is traveling on the hot asphalt material. The advantage of employing an infrared sensor array also becomes particularly apparent in this embodiment. An infrared sensor array may be arranged at the rubber-tired roller, for example inside the wheel box of the chassis part or at a thermal skirt, or a holder thereof, provided for this chassis part, in such a manner that the temperature of every single tire of the chassis part can be measured by the temperature sensor. At least one pixel of the measuring area is therefore located on every single one of the tires. In this manner, the temperature of all tires of the chassis part can be determined with only one single temperature sensor. The solution according to the invention is therefore particularly cost-effective since it is not necessary, for example, to employ a separate temperature sensor for every single tire to be measured.

The invention can also be employed in an advantageous manner for rubber-tired rollers in which both the front and rear chassis parts include tires. In this case, a total of two optical temperature sensors is preferably provided, wherein one optical temperature sensor determines the temperature of at least one tire of the front chassis part and the other optical temperature sensor determines the temperature of at least one tire of the rear chassis part. More particularly, each of the two temperature sensors determines the temperature of all tires arranged in the respective chassis part. All in all, it is thus made possible to determine the temperature of all tires by employing only two temperature sensors at the rubber-tired roller. The operator of the rubber-tired roller, who is provided with an indication of the corresponding measuring results, can use this information to control the sprinkler system in a particularly efficient manner. Each of the temperature sensors is therefore particularly preferably configured as an infrared sensor array or a temperature scanner.

As already suggested, an indicating device may be provided via which the temperatures of the tires as determined by the temperature sensor can be indicated to the operator. The operator can therefore decide based on the tire temperature whether sprinkling with separating agent performed by the sprinkler system is necessary to prevent asphalt from adhering to the tires. According to a preferred embodiment, however, the control unit is configured to control, in particular at least activate and/or deactivate, the sprinkler system autonomously based on the measured values of the temperature sensor. This may be done additionally or alternatively to the provision of an indicating device. Provision is thus made for the control unit to control the sprinkler system directly and automatically based on the temperatures of the tires measured by the temperature sensor or temperature sensors without the operator having to take action in this regard. This eliminates the last subjective influence involved in the control of the sprinkler system and at the same time relieves the operator of the rubber-tired roller, so that he can concentrate on other activities of the compaction process. For example, the control unit activates the sprinkler system when the temperature of the at least one tire is below a predetermined threshold value. Moreover, the control unit may deactivate the sprinkler system when the temperature of the tire is above a, or said, specified threshold value. Depending on the asphalt material used, different threshold values may be preset here. Typical threshold values range, for example, from 60° C. to 110° C., and may in particular be 80° C. The threshold value suitable for a given situation depends on the softening point of the bitumen type used in the asphalt mixture. It is further preferred here that the rubber-tired roller or the aforementioned control unit can optionally be switched to a "rolling mode" and/or a "sprinkling mode", in particular in order to prevent the control unit from automatically activating the sprinkler system in normal transportation operation, i.e. when not in rolling operation, when both the ground and the tires are cold.

In particular in configurations in which the temperature sensor determines the temperature of more than one tire within a chassis part, this additional information is then preferably also used to control the sprinkler system. It is, for example, preferred that more than two tires are arranged next to one another in the front chassis part and/or in the rear chassis part, and that the control unit is configured to control the sprinkling of the tires arranged at external positions transversely to a working direction separately from the tire or tires arranged between these tires. At the same time, the sprinkling device is advantageously configured such that it can sprinkle the tires arranged at external positions transversely to the working direction independently of the other tires of a chassis part. As already suggested, it happens that the tires of a chassis part which are located at external positions transversely to the working direction are colder than those located between these tires. This is because the tires arranged at external positions are cooled down to lower temperatures by the environment. The outer tires thus require continued sprinkling when the inner tires have already reached the necessary temperature for dispensing with sprinkling. To avoid unnecessary sprinkling of the already hot inner tires, the control unit deactivates the sprinkling of the tires located at internal positions while the tires of the chassis part located at external positions transversely to the working direction continue to be sprinkled until they have also reached the necessary temperature.

In particular in the case in which the temperatures of all tires of the rubber-tired roller are determined via the temperature sensor or sensors, the control unit is preferably configured such that it controls the sprinkling of each tire independently of the other tires. Of course, the sprinkler system is accordingly likewise configured such that the sprinkling of every single tire can be activated or deactivated independently of the other tires. For example, the sprinkler system includes a spray bar having a separate spray nozzle for each tire, each spray nozzle having a separate valve that can be selected individually by the control unit. In this manner, the control unit can address any asymmetry in the temperatures of the tires individually. For any temperature distribution amongst the tires, the control unit respectively activates the sprinkling for those tires having a temperature below a predetermined threshold value, whereas the control unit deactivates the sprinkling for those tires having a temperature above a predetermined threshold value. The threshold values already mentioned above may also be employed here. Due to the controlled sprinkling of every single tire independently of the other tires, the sprinkling with separating agent is in fact performed only for those tires and in that temperature range where adherence of the asphalt material to the tires is possible. The separating agent is thus utilized in a particularly efficient manner, and the consumption of the separating agent is reduced drastically.

The precision in the control of the sprinkler system, and thus the efficiency of the separating agent consumption, can generally already be increased based on the measured temperature of the tires. As explained above, the asphalt material adheres to the tires when the hot asphalt material is cooled down by the cold tires and thus its viscosity is increased. An essential factor for the adherence of the asphalt material thus consists in the temperature difference between the ground, i.e. the asphalt material, and the tires of the rubber-tired roller. The temperature sensor is therefore preferably configured and arranged such that, in addition to the temperature of the at least one tire, the temperature of the ground can also be determined. In other words, at least one measuring point of the measuring area of the temperature sensor is located on the ground, so that its temperature can be measured by the temperature sensor. This can, for example, likewise be achieved in an advantageous manner by an infrared sensor array which has enough pixels or measuring points to cover all tires of a chassis part and also the ground and to determine the respective temperatures. It is particularly preferred that, in addition to the temperature of each tire, the temperature of the ground portion traversed by this tire is also determined. Thus, two temperatures are measured for each tire of the rubber-tired roller, i.e. one that corresponds to the running surface of the tire and one that corresponds to the ground area contacting this running surface.

The temperature of the ground can then also be taken into consideration by the control unit in the control of the sprinkler system. For example, the control unit is preferably configured to activate the sprinkling performed by the sprinkler system when the temperature of the ground is above a threshold value and to deactivate the sprinkler system when the temperature difference between the ground and the tire falls below a predetermined threshold value. This line of action is preferably implemented in a hierarchical manner, more specifically such that the ascertained temperature difference is used for deactivation only in the case of a sprinkler system that has previously been activated upon determining of the temperature of the ground to be above a threshold value, i.e. "warm ground", which would per se trigger activation of the sprinkler system due to the temperature. The threshold value for the temperature of the ground or the asphalt layer above which the control unit will activate the sprinkler system is, for example, between 40° C. and 80° C., for example at 55° C. The temperature difference between the ground or the asphalt layer and the tire below which the control unit will deactivate the sprinkling is, for example, between 10° C. and 50° C., for example at 20° C. These values may likewise vary depending on the asphalt material used and depend on the respective ground temperature. For a temperature which is only slightly above the activation temperature of the sprinkler system, the tire temperature must not be significantly lower than the ground temperature. For very high asphalt temperatures such as 130° C., a tire temperature of 80° C. may already be sufficient to avoid adherence. Through the automatic activation and deactivation of the sprinkler system, in particular for every single tire and in consideration of the temperature of the ground portion traversed by this tire, the sprinkling is prevented from being turned on too late when adherence of asphalt material to the tires has already occurred. In addition, unnecessary use of sprinkling emulsion when there is no risk of adherence is also prevented.

Additionally or alternatively, provision may also be made for a device for the detection, in particular optical detection, of the external surface of at least one rubber tire, for example a digital camera. With such a camera, and with the aid of a suitable image processing software, it can additionally be ascertained whether or not there is actual adherence. This information can also be indicated to the operator of the rubber-tired roller and/or can be used for controlling the control unit of the sprinkler system, for example for manual setting of at least one threshold value by the driver.

To further improve the control of the sprinkler system, the control unit is preferably configured to automatically turn the previously activated sprinkling performed by the sprinkler system off when the ascertained temperature of the ground is below a threshold value. Thus, once the asphalt material has cooled down far enough that there is no longer a risk of adherence to the tires of the rubber-tired roller, the previously activated sprinkler system is automatically deactivated and an unnecessary consumption of separating agent is thus prevented. This turning off likewise preferably concerns the sprinkling of every single tire individually based on the temperature of the ground portion traversed by the corresponding tire.

Moreover, provision may also be made for the control unit to be configured to turn the sprinkling through the activated sprinkler system off when the temperature difference between the ground and the tire falls below a specified threshold value. This saves further separating agent when there is no longer a risk of adherence of the asphalt material to the tire due to the cooling of the material through contact with the tire.

The control of the sprinkler system described above is preferably effected for each tire of the rubber-tired roller individually and independently of the other tires, i.e. of the sprinkling of the other tires of the rubber-tired roller. The sprinkling of a tire thus merely depends on the temperature of this tire and the temperature of the ground, in particular the ground portion traversed by this tire, as well as the temperature difference between the tire and the ground, i.e. this ground portion. The decision as to whether or not a tire is sprinkled with separating agent is made by the control unit based on the measured values of the temperature sensor measuring the temperature of the respective tire. The operator of the rubber-tired roller no longer needs to issue any control commands in this regard. The control unit therefore controls the sprinkling automatically depending on the objectively determined demand of the individual tire.

As already mentioned, the temperature sensor needs to be arranged such that at least the tires to be measured and, if applicable, the ground are located within its measuring area. The temperature sensor may, for example, be arranged inside the wheel box of the rubber-tired roller. However, it should further be noted that the temperature sensor should be arranged such that it is protected as far as possible against the rough working conditions inside the wheel box. The temperature sensor is therefore preferably arranged in the upper half, preferably in the upper third, more preferably in the upper quarter, even more preferably in the upper fifth, and ideally at the upper apex of a wheel box. Moreover, it is possible, for example, to arrange the temperature sensor recessed into a chamber or sensor sight opening which opens into the wheel box and provides a free field of vision to the tires to be measured and, if applicable, the ground for the sensor. Due to the offset of the temperature sensor into a chamber, the sensor is additionally protected against negative environmental influences. In addition, provision may be made for a blow-off apparatus which prevents the temperature sensor, in particular infrared temperature sensor, from becoming clogged.

The object mentioned above is further achieved with a method for controlling a sprinkler system of a rubber-tired roller, in particular a rubber-tired roller as described above, comprising the steps of: determining the temperature of at least one tire, in particular the running surface of said tire, by means of a temperature sensor, and controlling the sprinkling of said at least one tire performed by the sprinkler system based on the measured values of the temperature sensor by means of a control unit. All features, advantages and effects discussed above with regard to the rubber-tired roller also apply analogously to the method according to the invention. The respective threshold values likewise correspond to the values mentioned above. Therefore, to avoid repetitions, reference is made to the above discussion.

The method in particular comprises at least one of the following steps: determining the temperature of at least two tires, in particular the running surface of the respective tire, by means of a temperature sensor, determining the temperature of all tires of the respective chassis part, in particular the running surface of the respective tire, by means of a temperature sensor, determining the temperature of all tires of the front and rear chassis parts, in particular the running surface of the respective tire, by means of one respective temperature sensor for each of the front chassis part and the rear chassis part, controlling the sprinkling of tires arranged at external positions transversely to a working direction separately from the tire or tires located between these tires, controlling the sprinkling of every single tire independently of the remaining tires, determining the temperature of the ground, activating the sprinkling performed by the sprinkler system when the temperature of the ground is above a threshold value and/or the temperature difference between the ground and the tire exceeds a specified threshold value, and deactivating the sprinkling performed by the sprinkler system when the temperature of the ground is below a threshold value, and/or deactivating the sprinkling performed by the sprinkler system when the temperature difference between the ground and the tire falls below a specified threshold value.

BRIEF DESCRIPTION OF THE DRAWINGS

The invention will now be explained in more detail by reference to the embodiment examples shown in the figures. In the schematic figures.

DETAILED DESCRIPTION

Figure 1:
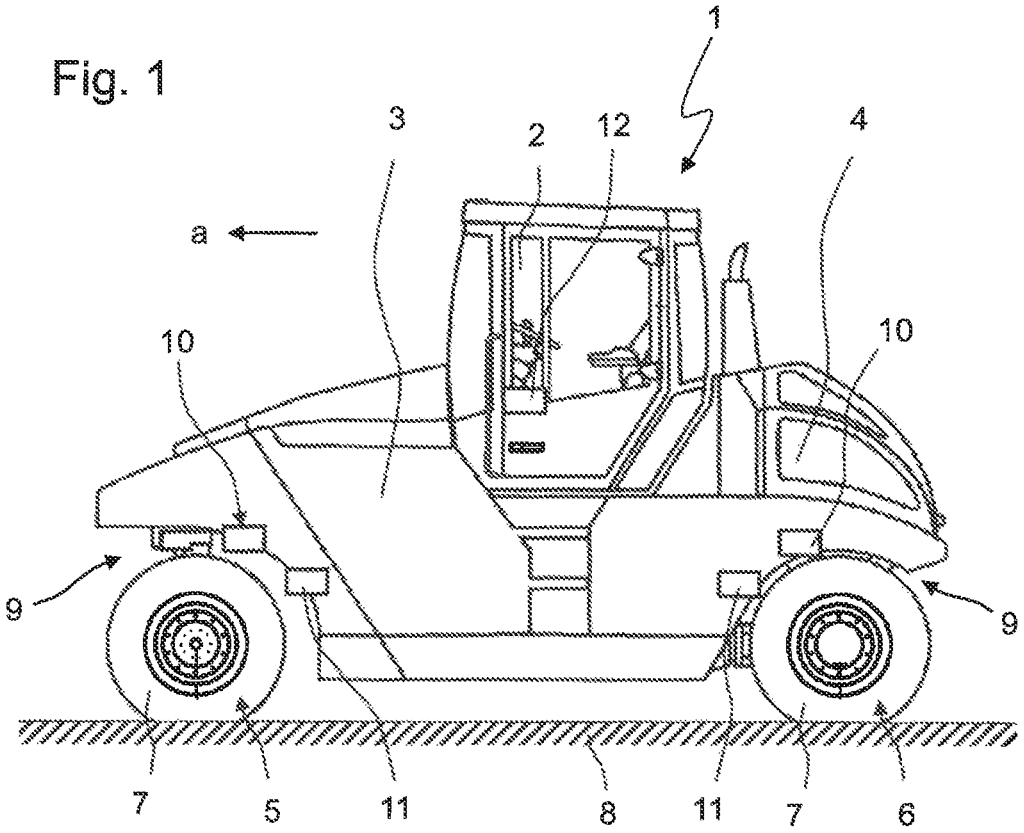
FIG. 1 is a side view of a rubber-tired roller.

Like parts, or parts acting in a like manner, are designated by like reference numerals. Recurring parts are not separately designated throughout the figures.

Figure 2:
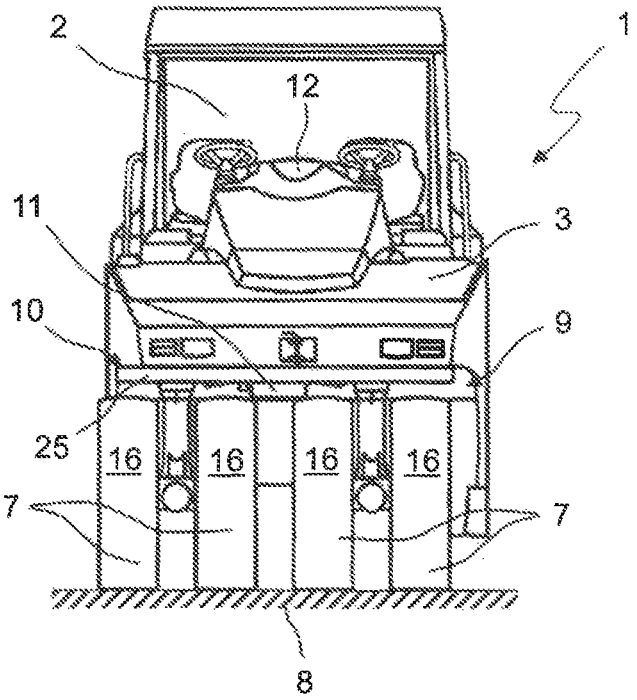
FIG. 2 is a front view of a rubber-tired roller.

FIGS. 1 and 2 show a rubber-tired roller 1. FIG. 1 is a side view of the rubber-tired roller 1, and FIG. 2 is a top view. The rubber-tired roller 1 comprises an operator platform 2 and a machine frame 3 supported by a chassis with a front chassis part 5 and a rear chassis part 6. Each of the chassis parts 5, 6 has tires 7 arranged in wheel boxes 9, with which the rubber-tired roller 1 travels over the ground 8 to be compacted. The power required for this is provided by a drive engine 4, for example a diesel combustion engine. In the present context, the forward traveling direction of the rubber-tired roller 1 is referred to as the working direction a although the rubber-tired roller 1 is also capable of compacting the ground 8 when traveling backwards in working operation. Moreover, FIGS. 1 and 2 show a respective temperature sensor 11 arranged at each of the front chassis part 5 and the rear chassis part 6, which has a measuring area that comprises the tires 7, in particular their running surfaces 16 (FIG. 2), and the ground 8, as will be explained in more detail below. Further, a respective sprinkler system 10 with a spray bar 25, which extends transversely to the working direction a and is configured such that a separating agent can be sprayed onto all tires 7 of the respective chassis part 5, 6, is located at each of the front chassis part 5 and the rear chassis part 6. The control unit 12 controls the sprinkler systems 10 based on the measured values of the temperature sensors 11.

Figure 3:
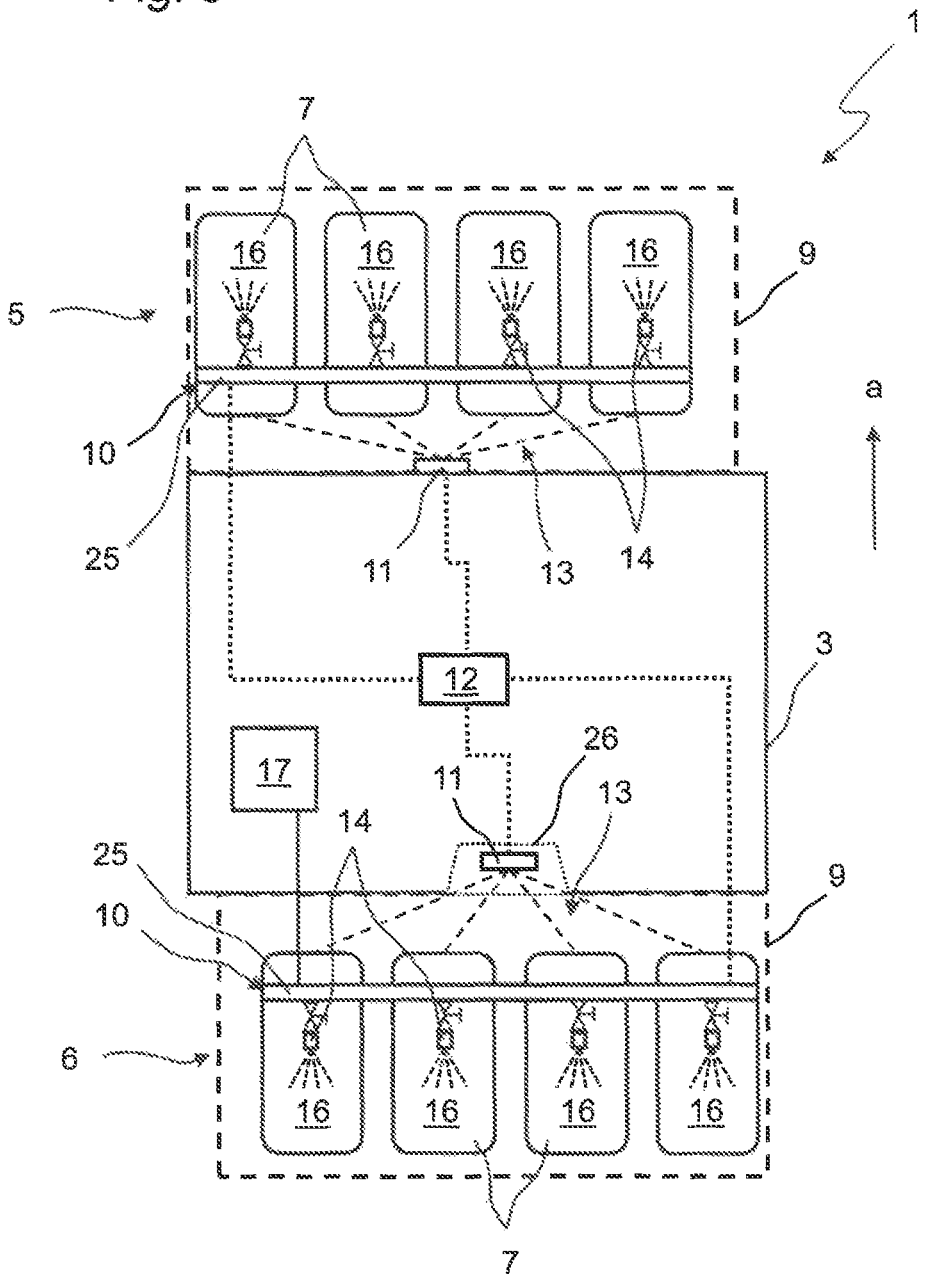
FIG. 3 is a top view of parts of the machine frame, the chassis and the sprinkler system.

FIG. 3 is a top view of the parts of the rubber-tired roller 1 that are essential for the invention. For reasons of clarity, parts of the machine frame 3, the operator platform 2 and the drive engine 4, as well as further components of the rubber-tired roller 1, are not shown. In this embodiment example, the rubber-tired roller 1 has four tires 7 arranged next to one another in the front chassis part 5 and also four tires 7 in the rear chassis part 6, which are in each case arranged in a respective wheel box 9. The tires 7 of the front chassis part 5 are offset relative to the tires 7 of the rear chassis part 6 transversely to the working direction a to ensure uniform compaction of the ground 8 during a traversal of the rubber-tired roller 1. Each of the front chassis part 5 and the rear chassis part 6 includes a sprinkler system 10. The sprinkler system 10 comprises a spray bar 25 which extends transversely to the working direction a and has at least one sprinkling nozzle 14 per tire 7 arranged thereon. As suggested in FIG. 3, a liquid separating agent can be applied to the running surface 16 of the respective tire 7 via the sprinkling nozzles 14. A tank 17, which is connected to the sprinkler system 10 and supplies the latter with separating agent, is provided at the rubber-tired roller 1 for storage of the separating agent. In FIG. 3, the connection between the sprinkler system 10 and the tank 17 is merely shown for the sprinkler system 10 of the rear chassis part 6. However, the sprinkler system 10 of the front chassis part 5 is connected to a separating agent tank 17 as well. Said tank may be the same tank 17 that is also connected to the sprinkler system 10 of the rear chassis part 6, or it may be a separate tank 17.

What is important about the sprinkler system 10 is that the control unit 12 is to control the sprinkling of the running surfaces 16 of the tires 7 through the individual sprinkling nozzles 14. For this, the control unit 12 is, on the one hand, in control connection with the sprinkler system 10, as suggested in FIG. 3. Moreover, each sprinkling nozzle 14 of the spray bar 25 includes its own controllable valve, which can be opened or closed by the control unit 12. Every single valve of a sprinkling nozzle 14 can be selected for opening or closing by the control unit 12 separately and individually, i.e. independently of all other valves. The control unit 12 thus decides for every single tire 7 whether or not this tire 7 needs to be sprinkled with separating agent in the current working operation. The control unit 12 resorts to the measured values of the temperature sensors 11 to make this decision. As shown in FIG. 3, one temperature sensor 11 is located at the front chassis part 5 and another temperature sensor 11 is located at the rear chassis part 6. Both temperature sensors 11 are in control connection with the control unit 12. The temperature sensor 11 for the front chassis part 5 is arranged in the wheel box 9 of the front chassis part 5. It may be arranged either at the machine frame 3 or at a holder for a thermal skirt of the chassis part (not shown) or at the thermal skirt itself. The temperature sensor 11 of the rear chassis part 6 is offset towards the interior of the rubber-tired roller 1 when viewed from the wheel box 9. The temperature sensor 11 is in particular arranged inside a chamber 26 which is configured so as to be optically open towards the rear chassis part 6. This means in particular that the temperature sensor 11 has a free field of vision, in particular in the infrared range, from the chamber 26 to the tires 7 of the chassis part and the ground 8. The offset of the temperature sensor 11 towards the machine center narrows, on the one hand, the measuring angle required for spanning a sufficiently large measuring area 13 of the temperature sensor 11. On the other hand, the chamber 26 protects the temperature sensor 11, so that the latter is not damaged by asphalt pieces which may be tossed around inside the wheel box 9. The arrangement of the temperature sensors 11 in FIG. 3 is merely an example. For example, both temperature sensors 11 may be arranged in the wheel box 9 or in a chamber 26 as respectively suggested for the two chassis parts 5, 6 in an exemplary manner.

Figure 4:
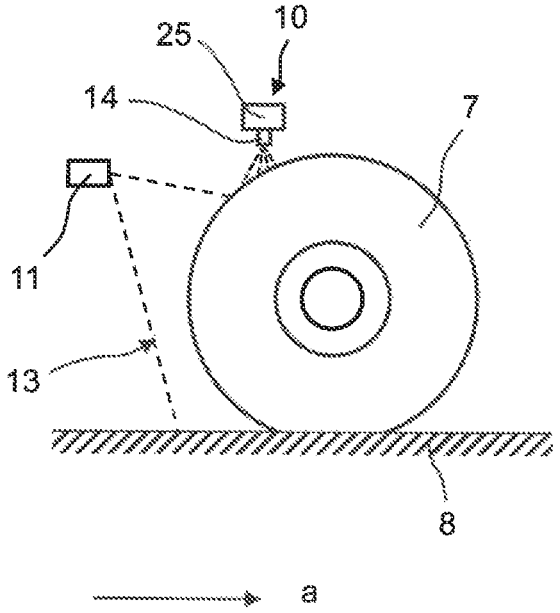
FIG. 4 is a side view of a tire with sprinkler system and temperature sensor.
Figure 5:
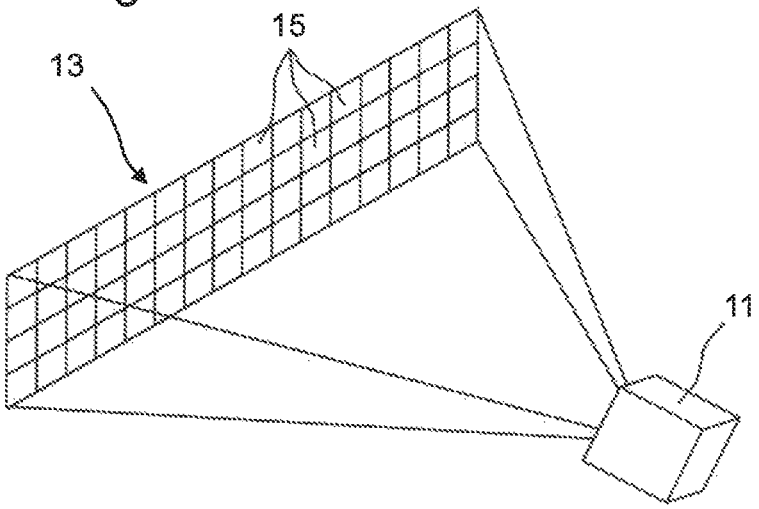
FIG. 5 shows a temperature sensor and its measuring area.

The function of the temperature sensors 11 and the shape of the measuring area 13 or field of vision of the temperature sensors 11, which is also already suggested in FIG. 3, becomes particularly apparent through additional consideration of FIGS. 4 and 5. As shown in particular in FIG. 5, the measuring area 13 of the temperature sensor 11 comprises multiple measuring points 15, i.e. pixels. In the embodiment example shown in FIG. 5, the temperature sensor 11, which is configured as an infrared sensor array, has a measuring area 13 of 16×4 measuring points 15. Similar to a thermal imaging camera, the temperature sensor 11 thus determines or measures the temperature of an object on which the respective measuring point 15 is located. The measuring area 13 thus is, so to speak, the field of vision of the temperature sensor 11. The extension of the measuring area 13 can in particular be taken from a synopsis of FIGS. 3 and 4. As can be taken from FIG. 3, the temperature sensor 11 is configured and arranged such that the measuring area 13 covers all tires 7 of the respective chassis part 5, 6. More particularly, at least one measuring point 15 is located completely on the running surface 16 of each tire 7 of said chassis part 5, 6. The measuring area 13 of the temperature sensor 11 thus extends at least across all running surfaces 16 of the tires 7 transversely to the working direction a. In this manner, it is ensured that the temperature sensor 11 can associate the respective tire 7 with at least one measuring point 15, so that the temperature of each tire 7 can be determined.

FIG. 4 is a side view of a tire 7 of the front chassis part 5. Also shown are the temperature sensor 11 and the extension of the measuring area 13 viewed from this perspective. FIG. 4 illustrates in particular that the measuring area 13 of the temperature sensor 11 comprises both the tire 7 and the ground 8. In other words, the temperature sensor 11 is configured and arranged such that, within its measuring area 13, at least one measuring point 15 is located completely on the running surface 16 of at least one single tire 7, and in particular every single tire 7, of the corresponding chassis part 5, 6 (in FIG. 4, for example, the front chassis part 5) and also at least one measuring point 15 is located completely on the ground 8, that is the asphalt layer to be compacted. All in all, the temperatures of all tires 7 of the rubber-tired roller 1 and the ground 8 can thus be determined via the two temperature sensors 11. Moreover, due to the shape of the measuring area 13 according to FIG. 5, it is possible that the temperature sensor 11 determines the temperature of the ground 8 individually for each tire 7. It is in particular possible to correlate a respective measuring point 15 on the ground 8 with each measuring point 15 located on a tire 7, in particular on the running surface 16 of the tire 7, wherein said measuring point 15 for the ground 8 and said measuring point 15 for the tire 7 are located in a same vertical plane oriented parallel to the working direction a. In other words, the temperature sensor 11 determines both the temperature of the tire 7 and the temperature of the ground 8, i.e. the ground portion traversed by said tire 7. In this manner, a temperature difference relative to the ground 8 can be measured or determined individually for each tire 7. The temperature sensor 11 thus ideally determines, for each tire 7, both the temperature of the tire 7 itself and the temperature of the ground 8 or ground portion traversed by said tire 7.

Figure 6:
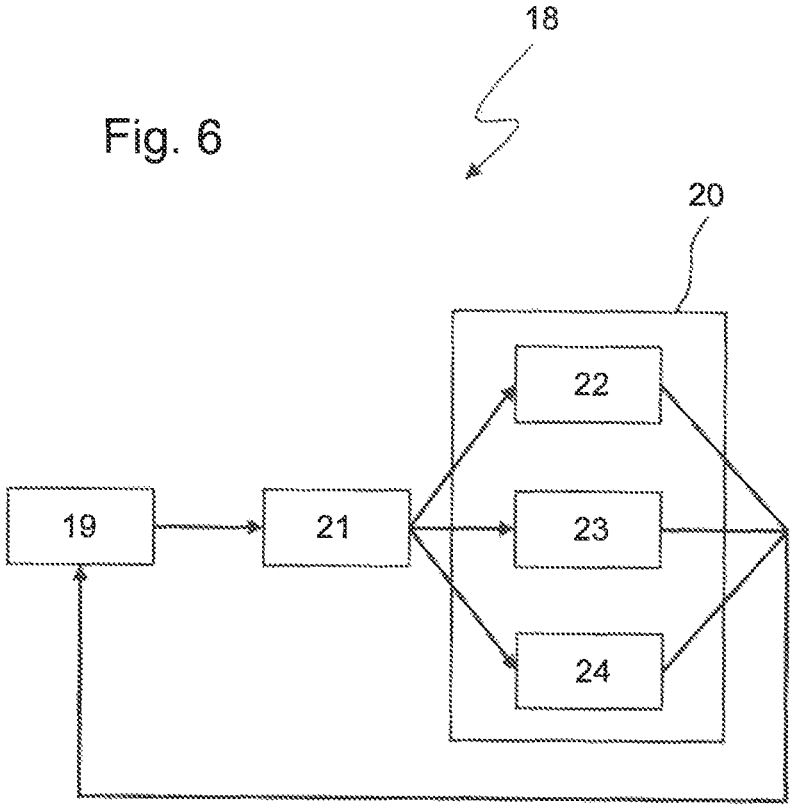
FIG. 6 is a flow chart of the method.

This information is used by the control unit 12 to control the sprinkler systems 10. The control unit 12 is in particular configured to carry out the method 18 according to the flow chart shown in FIG. 6. In step 19 of the method 18, the tire temperatures are determined. More particularly, the temperature of all tires 7 of the rubber-tired roller 1 is respectively determined via one single temperature sensor 11 per chassis unit 5, 6. In step 21, at least one of the temperature sensors 11 additionally also determines the temperature of the ground 8. Moreover, each temperature of a tire 7 measured by the temperature sensor 11 can be correlated with a temperature of the ground 8 traversed by said tire 7. In step 20, the control unit 12 then controls the sprinkler system 10. Said controlling may comprise several control commands. If, for example, the temperature of the ground 8 is determined to be above a predetermined threshold value, for example above 55° C., and if, for example, the temperature difference between the ground 8 and the tire 7, in particular the ground portion traversed by said tire 7 and said tire 7 itself, is determined to exceed a specified threshold value, for example a threshold value of 10° C., the control unit 12 activates, according to step 22, the sprinkling of said tire 7 via the sprinkling nozzle 14. If, on the other hand, the temperature of the ground 8 is, for example, determined to be below a predetermined threshold value, for example below 5° C., the control unit 12 deactivates, according to step 23, the sprinkler system 10, and in particular the sprinkling of the tire 7 traversing the ground portion having said temperature below said threshold value. If the temperature difference between the ground 8 and the tire 7 is determined to have fallen below a specified threshold value, for example a threshold value of 10° C., according to step 24, the sprinkling is likewise deactivated, in particular the sprinkling of the tire 7 for which a sufficient temperature difference relative to the ground portion traversed by said tire 7 no longer exists.

All in all, this provides an efficient and objective control of the sprinkler systems 10 by the control unit 12 based on the measured values of the temperature sensors 11, which removes all subjective influences from the control of the sprinkler systems 10. The invention thus results in a particularly precise control of the sprinkler system 10, which guarantees, on the one hand, that the ground layers to be compacted are not damaged by material adhering to the tires 7 of the rubber-tired roller 1 and, on the other hand, results in a particularly economic and effective utilization of the separation agent. This results in a lower overall consumption of separating agent, so that, for example, less time needs to be spent on refilling the separating agent storage tank. The invention therefore increases the overall economic efficiency of the rubber-tired roller 1.

What is claimed is:

1. A rubber-tired roller for compacting ground for asphalt compaction, comprising:

a machine frame;

a drive engine;

a chassis driven by the drive engine with a front chassis part and a rear chassis part, at least one of the front chassis part and the rear chassis part comprising at least two tires with the at least two tires each having a running surface;

at least one sprinkler system for the at least two tires of the chassis part, which is configured to apply a liquid separating agent to the running surface of each tire of the at least two tires;

a control unit for controlling the sprinkler system;

at least one temperature sensor configured and arranged to determine a temperature of the running surface of at least one tire of the at least two tires; and wherein the temperature sensor is further configured and arranged to determine a temperature of the ground which is traversed by the at least one tire of the at least two tires.

2. The rubber-tired roller according to claim 1, wherein the temperature sensor is an optical temperature sensor with a measuring area and at least one measuring point, and comprises an infrared sensor array.

3. The rubber-tired roller according to claim 2, wherein the optical temperature sensor is configured and arranged such that the measuring area comprises the at least one measuring point on the running surface of the at least one tire of the at least two tires.

4. The rubber-tired roller according to claim 2, wherein the optical temperature sensor is configured and arranged such that the measuring area comprises at least one measuring point on the running surface of each tire of the at least two tires of the chassis part.

5. The rubber-tired roller according to claim 2, wherein each of the front chassis part and the rear chassis part comprises at least two tires with the at least two tires each having a running surface, and that a total of two optical temperature sensors are provided, wherein one optical temperature sensor of the optical temperature sensors determines a temperature of the running surface of at least one tire of the at least two tires of the front chassis part and the other optical temperature sensor of the optical temperature sensors determines a temperature of the running surface of at least one tire of the at least two tires of the rear chassis part.

6. The rubber-tired roller according to claim 1, wherein the control unit is configured to control the sprinkler system based on measured values of the temperature sensor.

7. The rubber-tired roller according to claim 6, wherein at least one of the front chassis part and the rear chassis part comprises more than the at least two tires in the front chassis part and/or in the rear chassis part, respectively, and the control unit is configured to control sprinkling of tires of the more than two tires arranged at external positions transversely to a working direction of the roller separately from one or more tires of the more than two tires arranged between the tires arranged at the external positions.

8. The rubber-tired roller according to claim 6, wherein the control unit is configured to control sprinkling of the at least two tires independently of one another.

9. The rubber-tired roller according to claim 1, wherein the control unit is configured to activate sprinkling performed by the sprinkler system when the temperature of the ground is above a threshold value and a temperature difference between the ground and the at least one tire of the at least two tires exceeds a specified threshold value.

10. The rubber-tired roller according to claim 1, wherein the control unit is configured to turn sprinkling performed by the sprinkler system off when the temperature of the ground is below a threshold value.

11. The rubber-tired roller according to claim 1, wherein the control unit is configured to turn sprinkling performed by the sprinkler system off when a temperature difference between the ground and the tire falls below a specified threshold value.

12. The rubber-tired roller according to claim 1, wherein the temperature sensor is arranged in an upper half at an upper apex of a wheel box.

13. A method for controlling a sprinkler system of a rubber-tired roller, comprising the steps of:

operating the rubber-tired roller, wherein the rubber-tired roller comprises a machine frame;

a drive engine;

a chassis driven by the drive engine with a front chassis part and a rear chassis part, at least one of the front chassis part and the rear chassis part comprising at least two tires with the at least two tires each having a running surface;

at least one sprinkler system for the at least two tires of the chassis part, which is configured to apply a liquid separating agent to the running surface of each tire of the at least two tires;

a control unit for controlling the sprinkler system;

at least one temperature sensor configured and arranged to determine a temperature of the running surface of at least one tire of the at least two tires; and wherein the temperature sensor is further configured and arranged to determine a temperature of the ground which is traversed by the at least one tire of the at least two tires;

determining a temperature of the running surface of the at least one tire of the at least two tires with the temperature sensor;

determining a temperature of the ground which is traversed by the at least one tire of the at least two tires with the temperature sensor; and controlling a sprinkling of the at least one tire of the at least two tires performed by the sprinkler system with the control unit based on measured values of the temperature sensor for the temperature of the running surface of the at least one tire of the at least two tires and the temperature of the ground which is traversed by the at least one tire of the at least two tires.

14. The method according to claim 13, wherein the at least two tires of the chassis part provide at least a portion of all tires of the chassis part, and all the tires of the chassis part each have a running surface, and wherein the step of determining the temperature of the running surface of the at least one tire of the at least two tires with the temperature sensor further comprises:

determining the temperature of the running surface of each tire of the at least two tires with the temperature sensor; and/or determining the temperature of the running surface of all the tires of the respective chassis part with a temperature sensor.

15. The method according to claim 13, wherein the at least one of the front chassis part and the rear chassis part comprising at least two tires with the at least two tires each having a running surface further comprises each of the front chassis part and the rear chassis part comprising at least two tires with the at least two tires each having a running surface, respectively; and wherein the at least one temperature sensor configured and arranged to determine a temperature of the running surface of at least one tire of the at least two tires and to determine a temperature of the ground which is traversed by the at least one tire of the at least two tires further comprises a first temperature sensor configured and arranged to determine a temperature of the running surface of at least one tire of the at least two tires of the front chassis part and a second temperature sensor configured and arranged to determine a temperature of the running surface of at least one tire of the at least two tires of the rear chassis part; and the step of determining the temperature of the running surface of the at least one tire with the temperature sensor further comprises determining the temperature of the running surface of at least one tire of the at least two tires of the front chassis part with the first temperature sensor and determining the temperature of the running surface of at least one tire of the at least two tires of the rear chassis part with the second temperature sensor.

16. The method according to claim 13, wherein the step of determining the temperature of the running surface of the at least one tire of the at least two tires with the temperature sensor further comprises determining the temperature of the running surface of each tire of the at least two tires with the temperature sensor;

wherein the step of determining the temperature of the ground which is traversed by the at least one tire with the temperature sensor further comprises determining the temperature of the ground which is traversed by each tire of the at least two tires with the temperature sensor; and wherein the step of controlling the sprinkling of the at least one tire of the at least two tires performed by the sprinkler system with the control unit based on measured values of the temperature sensor for the temperature of the running surface of the at least one tire of the at least two tires and the temperature of the ground which is traversed by the at least one tire of the at least two tires further comprises controlling the sprinkling of each tire of the at least two tires performed by the sprinkler system with the control unit based on measured values of the temperature sensor for the temperature of the running surface of each tire of the at least two tires and the temperature of the ground which is traversed by each tire of the at least two tires, respectively.

17. The method according to claim 16, wherein the at least two tires are arranged adjacent one another and/or at least one tire of the at least two tires is arranged at an external position transversely to a working direction of the roller.

18. The method according to claim 13, further comprising:

activating the sprinkling performed by the sprinkler system when the temperature of the ground which is traversed by the at least one tire of the at least two tires is above a threshold value and a temperature difference between the temperature of the running surface of the at least one tire of the at least two tires and the temperature of the ground which is traversed by the at least one tire of the at least two tires exceeds a specified threshold value.

19. The method according to claim 13, further comprising:

deactivating the sprinkling performed by the sprinkler system when the temperature of the ground which is traversed by the at least one tire of the at least two tires is below a threshold value; and/or deactivating the sprinkling performed by the sprinkler system when the temperature of the ground which is traversed by the at least one tire of the at least two tires is above a threshold value and a temperature difference between the temperature of the running surface of the at least one tire of the at least two tires and the temperature of the ground which is traversed by the at least one tire of the at least two tires exceeds a specified threshold value.

20. A rubber-tired roller for compacting ground for asphalt compaction, comprising:

a machine frame;

a drive engine;

a chassis driven by the drive engine with a front chassis part and a rear chassis part, at least one of the front chassis part and the rear chassis part comprising at least two tires with the at least two tires each having a running surface;

at least one sprinkler system for the at least two tires of the chassis part, which is configured to apply a liquid separating agent to the running surface of each tire of the at least two tires; and a control unit for controlling the sprinkler system; and a temperature sensor configured and arranged to determine a temperature of the running surface of at least one tire of the at least two tires and a temperature of the ground simultaneously.

21. The rubber-tired roller according to claim 20, wherein the temperature sensor configured and arranged to determine the temperature of the running surface of at least one tire of the at least two tires and a temperature of the ground simultaneously is further configured and arranged to determine the temperature of the running surface of each tire of the at least two tires and a temperature of the ground simultaneously.

* * * * *